United States Patent [19]

Leap

[11] Patent Number: 4,778,111

[45] Date of Patent: Oct. 18, 1988

[54] TREE SOAKER

[76] Inventor: Earl J. Leap, Rte. 1, Box 232, Oak Grove, Mo. 64075

[21] Appl. No.: 96,652

[22] Filed: Sep. 15, 1987

[51] Int. Cl.[4] ..... B05B 1/14; B05B 1/30

[52] U.S. Cl. ..... 239/536; 239/553.3; 239/562; 239/565; 239/567; 239/581.1

[58] Field of Search ..... 239/542, 562, 565, 567, 239/581.1, 553.3, DIG. 15, 536

[56] References Cited

U.S. PATENT DOCUMENTS

| | | | |
|---|---|---|---|
| 273,940 | 3/1883 | Bonninghausen | 239/565 |
| 541,716 | 6/1895 | Callahan | 239/581.1 X |
| 648,263 | 4/1900 | Hull | 239/565 X |
| 2,151,214 | 3/1939 | Kramer | 239/562 X |
| 2,746,799 | 5/1956 | Nelson | 239/565 X |
| 2,771,320 | 11/1956 | Korwin | 239/565 X |
| 2,775,773 | 1/1957 | Marsh | 239/565 X |
| 2,909,328 | 10/1959 | Babyak | 239/542 X |
| 2,965,313 | 12/1960 | Jay | 239/581.1 |
| 3,185,397 | 5/1965 | Nelson | 239/567 X |
| 3,199,791 | 8/1965 | Chapin | 239/542 |
| 3,322,347 | 5/1967 | Pierce | 239/567 X |
| 3,482,785 | 12/1969 | Chapin et al. | 239/542 |
| 3,863,845 | 2/1975 | Bumpstead | 239/542 |
| 3,921,914 | 11/1975 | Hatt | 239/567 |
| 4,010,898 | 3/1977 | Williams | 239/547 X |
| 4,036,435 | 7/1977 | Pecaro | 239/542 |
| 4,162,041 | 7/1979 | Hane | 239/542 X |
| 4,181,051 | 1/1980 | Drori | 239/547 X |
| 4,194,695 | 3/1980 | Schopp | 239/542 |
| 4,452,397 | 6/1984 | Barton | 239/562 X |
| 4,562,963 | 1/1986 | Butler | 239/565 X |

FOREIGN PATENT DOCUMENTS

| | | | |
|---|---|---|---|
| 646610 | 8/1964 | Belgium | 239/565 |
| 307176 | 4/1933 | Italy | 239/567 |

*Primary Examiner*—Andres Kashnikow
*Assistant Examiner*—Mary Beth O. Jones
*Attorney, Agent, or Firm*—Litman, McMahon & Brown

[57] ABSTRACT

An irrigation apparatus for controlled watering of large plants, such as trees, shrubs and the like includes a hose connection for connecting to a garden hose or the like, a control valve for adjusting the flow of water through the apparatus, a manifold connected at one end thereof to the valve and also being flow connected to a pair of tubular arms and a pair of weights attached to the tubular arms at distal ends thereof. The tubular arms are flexible and adapted to wrap around the base of a tree or the like and are held in place against thermal expansion or water pressure acting within the tubular arms by the weighted ends. The tubular arms also have a plurality of spaced apertures along upper sides thereof. The valve has two flow apertures, one of which provides fixed relatively low flow and the other which is adjustable to provide for variation in water flow.

14 Claims, 1 Drawing Sheet

TREE SOAKER

BACKGROUND OF THE INVENTION

The present invention relates generally to plant irrigation devices and, in particular, pertains to an apparatus for the controlled irrigation of relatively large individual plants, such as shrubs and trees.

Due to ecological and cost considerations associated with the overusage of a limited water supply, it is desirable to water plants slowly thereby allowing water to soak into the ground around the plant, so as to provide the plant with sufficient water for growth and to maintain a high level of health, while minimizing or eliminating the wasting of water during such irrigation. In particular, if the plant is watered at too high a rate, not allowing time for the water to soak into the ground slowly, then the surface of the ground becomes supersaturated and the excess water will run off and be wasted. Furthermore, the excess water usage is reflected in higher utility bills.

Various irrigation systems have been previously used for years, as is shown in U.S. Pat. Nos. 3,199,791 and 3,482,785. The concept of providing a device for the watering of individual small plants was also demonstrated in U.S. Pat. No. 3,199,791 wherein a small leader hose projects from the main supply hose and extends individually to each plant and water is disbursed through one opening at the end of the leader hose. However, the '791 device was designed for small potted plants and not for trees or the like. Further, the water supply faucet in this device is located at the source of a feeding hose which is a substantial distance away, mounted on a side of a house or building, and this makes effective adjustment of the water flow inconvenient or very difficult, if the plant or leader hose outlet is not visible from the faucet.

As seen in U.S. Pat. No. 3,482,785, an improvement was made over the '791 patent wherein a valve was placed in the end of each leader arm so as to allow individual adjustment of the water flow to each individual plant. But the problem with this approach is that water is dispersed in only one particular location near the base of the plant, thereby leading to an uneven irrigation of the particular plant.

Consequently, an irrigation system is desired that provides an even distribution of water and covers a larger area around the base of the plant such that the entire root structure of the plant is watered evenly. Furthermore, a more convenient method of adjusting the water flow is necessary wherein the valve is not only located at or near the base of the tree or plant but includes at least one easy to locate position which will provide a known relatively low water flow rate. In addition, a system is needed which is adapted to effectively encircle a large plant and remain in a predetermined position relative to the plant during use and which is easily adjustable to the size of the plant and porosity of the ground.

OBJECT OF THE INVENTION

Therefore, the objects of the present invention are: to provide an irrigation apparatus which will be especially adapted to evenly water trees, shrubs or the like; to provide such an apparatus wherein the water flow is easily and precisely controlled so as to allow slow soaking and prevent runoff of excess water; to provide such an apparatus having flexible arms which encircle a tree or plant; to provide such an apparatus to allow even watering to all sides of the vegetation being watered; to provide such an apparatus wherein the arms are weighted so as to prevent movement of the arms from a desired location due to thermal movement or due to the forces resulting from the water pressure within the arms; to provide such an apparatus having a hose connection and control valve in close association to the arms such that a user may easily and simply adjust the proper flow of water through the apparatus at the site of use; to provide such an apparatus having a valve with an easy to find position with a small aperture which allows a small fixed amount of water flow and a second relatively larger aperture which is infinitely adjustable to vary water flow where higher flow rates are desired; to provide such an apparatus which is easy to manufacture, relatively inexpensive to make and which is particularly well adapted for the intended usage thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE INVENTION

Figure 1:
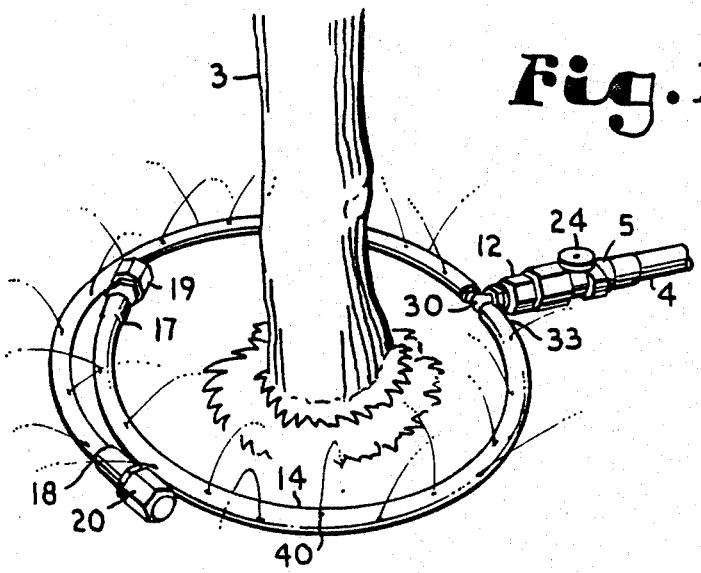
FIG. 1 shows a perspective view of an irrigation apparatus, in accordance with the present invention, connected to a water supply hose and surrounding a tree being watered thereby.
Figure 5:
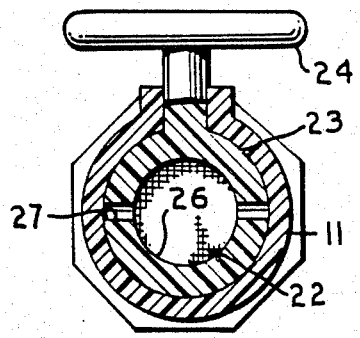
FIG. 5 is an enlarged and cross-sectional view of the apparatus, taken along line 5—5 of FIG. 2.
Figure 2:
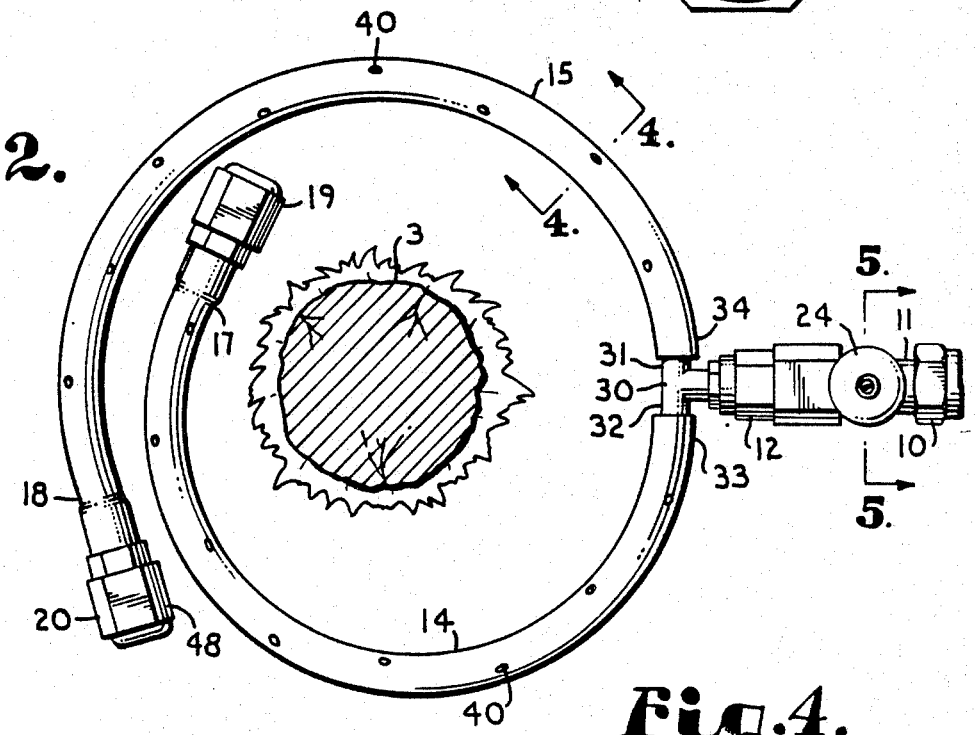
FIG. 2 is an enlarged top plan view of the soaker, tree and hose, showing a pair of arms.
Figure 3:
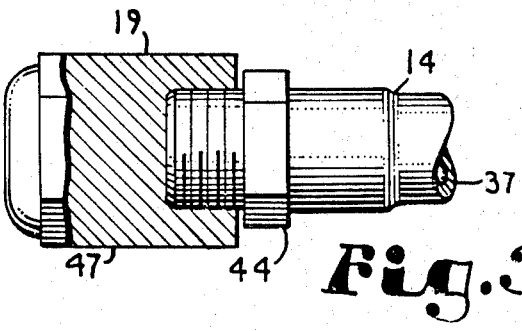
FIG. 3 is an enlarged and cross-sectional view of a portion of one of the apparatus arms, with portions broken away to show detail thereof.
Figure 4:
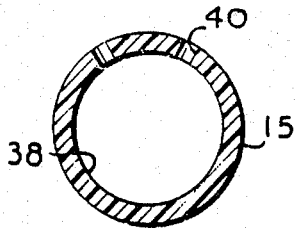
FIG. 4 is an enlarged and cross-sectional view of the apparatus, taken along line 4—4 of FIG. 2.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

The reference numeral 1 generally refers to a tree soaker or irrigation apparatus in accordance with the present invention. The apparatus 1 is illustrated surrounding a tree 3 being watered thereby and connected to a conventional water supply hose 4 to a male hose conection 5 on the hose 4. Although the apparatus 1 is illustrated in conjunction with a tree 4, it is foreseen that it may be utilized in conjunction with other large plants such as shrubs and the like.

The apparatus 1 comprises hose connection means, in particular, a female hose connectior 10 connected to a control valve 11 which in turn is flow connected to a manifold 12 which in turn is connected to a pair of tubular arms 14 and 15. Attached to distal ends of the arms 17 and 18 are weighted elements 19 and 20 respectively.

The hose connection 10 is a standard female hose connection adapted to mate with a cc,nventional garden hose 4 or the like. Positioned interior of the hose connection 10 is a filter element 22 extending across the entire interior of the hose connection 10 and adapted to filter sediment and large particles from the water passing into the apparatus 1.

Adjacent the hose connection 10 and in flow communication therewith is the valve 11. The valve 11, as illustrated, is a modified ball valve; however, it is foreseen that other types of valves could be modified in accordance with the teachings described herein to function suitably for this purpose. The valve 11 includes a valve body 23 positioned interiorly of the valve 11 and an actuator 24 attached to the body 23 to allow a user to manually adjust the position of the body 23 relative to the remainder of the valve 11. The body 23 includes a pair of apertures 26 and 27 therethrough. The aperture 26 is a relatively large opening and is designed to allow a substantial flow of water through the apparatus 1 when the valve 11 is fully opened so as to align the aperture 26 with the flow of water. The valve body 23 can be rotated 90° from the fully opened position so as to position the aperture 26 to align with the side walls of the valve 11 and preclude water from passing through the aperture 26. The aperture 27 is positioned generally perpendicular to the aperture 26 and also passes entirely through the valve body 23. The aperture 27 is relatively small in diameter compared to the aperture 26 and allows only a relatively small, non-adjustable and fixed flow of water to pass therethrough. It is preferred that the aperture 27 have a diameter of approximately one and one-half millimeter; however, this diameter may be modified to adjust for with the water pressure of a particular region or the like. When the aperture 26 is aligned so as to prevent flow of water therethrough, the aperture 27 is aligned to allow passage of water therethrough. It is foreseen that a third relationship could be incorporated in the valve 11 such that neither of the apertures 26 and 27 could allow flow therethrough, thereby totally stopping flow.

The manifold 12 functionally joins the valve 11 to the arms 14 and 15 and provides for closed flow communication of water therebetween. The manifold 12 is preferably designed to be relatively short in length such that the valve 11 is positioned close to the origin of the arms 14 and 15 as well as the hose connection 10 such that a user may easily adjust the flow of water passing through the apparatus 1 at the location where the apparatus 1 is utilized. The manifold 12 bifurcates into a T-shaped element 30 at the end thereof opposite the valve 11. The T-shaped element 30 has opposed nipples 31 and 32 which are sealably inserted into ends 33 8 and 34 of arms 14 and 15 respectively. In this manner, the interior of the arms 14 and 15 flow communicate through the manifold 12 with the interior of the valve 11 and subsequently with the interior of the hose connection 10.

The arms 14 and 15 are generally circular in cross-section and have interior flow channels 37 and 38 within the arms 14 and 15 respectively. Water is free to flow through the channel 37 of arm 14 from end 33 to end 17 of arm 14. Likewise, water is free to flow through the interior of channel 38 in arm 15 from the end 34 to the end 18 of the arm 15. Each arm 14 and 15 includes a plurality of relatively evenly spaced apertures 40 sequentially positioned so as to alternate between opposite sides of each arm 14 and 15 and aligned so as to the positioned on the upper side of a respective arm 14 or 15 when in use. In this manner, the apertures 40 allow spray to be directed both inwardly and outwardly of the arms 14 and 15 when in use encircling a plant.

The weighted elements 19 and 20 each include a fitting 44 and 45 for attaching to a respective arm 14 and 15. Each weighted element 19 and 20 also includes a relatively heavy weight 47 and 48 respectively constructed of lead or the like having a relatively high mass sufficient to maintain the position of the flexible arms 14 and 15 due to stresses placed upon the arms 14 and 15 by expansion or shrinkage due to ambient temperature changes or pressure exerted within the arms 14 and 15 by water therein.

In use, the apparatus 1 is attached by the hose connection 10 to a hose 4 or the like. The apparatus 1 is then positioned by a user around a tree 3 or the like such that the arms 14 and 15 generally encircle the tree at a spacing therefrom to provide water both inwardly and outwardly of the arms 14 and 15 and thereby soak the entire root ball associated with the tree 3 or other plant. The arms 14 and 15 are positioned such that the apertures 40 open generally upwardly. The water flow to the hose 4 is then initiated by the user. Subsequently, the user adjusts the valve 11 to provide only a slight trickle flow to the apparatus 1 by positioning the aperture 27 to be in flow communication between the water source and the arms 14 and 15 or alternatively, to allow a greater flow by positioning the aperture 26 so as to allow flow communication between the hose 4 and the arms 14 and 15. It is noted that the valve body 23 can be positioned such that the aperture 26 is not in full alignment with the flow stream of water and, therefore, the flow of water passing through the valve 11 is roughly adjustable through an infinite range of positions by operation of the acuator 24 if the user wants more than a slight trickle.

It is to be understood that while certain forms of the present invention have been illustrated and described herein, it is not to be limited to the specific forms or arrangement of parts described and shown.

What is claimed and desired to be secured by Letters Patent is as follows:

1. An irrigation apparatus comprising:

(a) hose connection means adapted to flow connect between a water supply and said irrigation apparatus;

(b) a flexible tubular arm flow connected to said hose connection means;

(c) a valve flow-positioned near said hose connection means and between said hose connection means and said tubular arm;

(d) said arm having an interior channel connected to said hose connection means; said arm having a plurality of spaced apertures passing through said arm so as to flow connect said channel with an exterior of said arm; said apertures being of a size to allow alternatively a trickle flow or a spray therethrough; said valve also flow positioned relatively near at least a portion of said apertures;

(e) said valve being at least a two positional valve having a first position associated with a first flow orifice sized relatively small and a second position associated within a second flow orifice sized relatively large, such that when said valve is in said first position, said apparatus is adapted to produce said trickle flow from said apertures and when said valve is in said second position, said apparatus is adapted to produce said spray from said apertures; and (f) a weighted element positioned at a distal end of said arm whereby said weighted element opposes movement of said arm under varying water pressures and varying ambient temperature conditions once said apparatus has been positioned for use.

2. The irrigation apparatus as set forth in claim 1 wherein:

(a) said valve includes valving means for variable control of water flow; said valving means allowing a user to select a relatively low flow therethrough to allow slow soaking of water into the ground around a plant;

(b) said valve of said irrigation apparatus having an infinitely positionable operator controlled actuator;

(c) said valve including a valve body having said first flow orifice and said second flow orifice; and (d) said body being positionable by means of said actuator to block flow of water through said first flow orifice while allowing flow through said second flow orifice.

3. The irrigation apparatus as set forth in claim 1 wherein:

(a) said arm apertures are located in generally evenly spaced relationship along the top of the arm and are positioned on opposite sides of the top of the arm so as to be adapted to spray water therefrom such that streams of water spray relatively both inward and outward when said flexible hose arm is positioned to encircle a plant.

4. The irrigation apparatus as set forth in claim 1 including:

(a) a filter located in said hose connection means to prevent the passage of foreign objects into said irrigation apparatus.

5. The irrigation apparatus as set forth in claim 1 including:

(a) a manifold between said valve and said arm, whereby water is allowed to flow from said valve through said manifold to said arm;

(b) said arm is a first arm and including a second flexible hose arm; and (c) said first and second arms each originate at said manifold and each have a closed distal end.

6. The irrigation apparatus as set forth in claim 5 wherein:

(a) a weighted element is positioned at the closed distal end of each of said first and second arms.

7. An irrigation apparatus comprising:

(a) hose connection means adapted to flow connect a water supply to said irrigation apparatus;

(b) a pair of flexible and tubular members forming a pair of arms and having a plurality of relatively evenly spaced apertures located along each of said arms to allow fluid to flow from an interior to an exterior of each arm; said apertures flow-connecting with said hose connection means through an associated tubular member; each of said arms being connected to a common manifold at one end thereof and having an opposite distal end; said apertures being of a size to allow alternatively a trickle flow or a spray therethrough;

(c) said arms being capable of being wrapped around the base of a plant so as to provide an even, circumferential distribution of water from said apertures;

(d) said manifold including a valve flow positioned to be relatively near the connection of each said arm to said manifold; said valve having both a relatively small flow and a large flow orifice therein; said valve being alternatively positionable such that either of said orifices are selectively positionable so as to require water passing through the valve to pass through only one of said orifices, such that said apparatus is adapted to provide alternatively relatively a large flow of water from said apertures to produce said spray or a small flow of water from said apertures to produce said trickle flow;

(e) a weighted element positioned at said distal ends of each of said arms whereby said weighted elements oppose movement of said arms under varying water pressures and ambient temperature condition.

8. The irrigation apparatus as set forth in claim 7 wherein:

(a) said valve includes valving means for variable control of water flow; said valving means allowing a user to select a relatively low flow therethrough to allow slow soaking of water into the ground around a plant;

(b) said valve of said irrigation apparatus having an operator controlled actuator being infinitely positionable;

(c) said valve having a valve body having said large flow orifice and said small flow orifice; and (d) said body being positionable by means of said actuator to block flow of water through said first flow orifice while allowing flow through said second flow orifice.

9. The irrigation apparatus as set forth in claim 7 wherein:

(a) said arm apertures are generally evenly spaced in spaced rows near the top of said arms and are located so as to be adapted to spray water such that streams of water spray relatively inward and outward when said flexible hose arms are placed in generally circumferential relationship to encircle a plant.

10. The irrigation apparatus as set forth in cliam 7 including:

(a) a filter located in said hose connection means to prevent the passage of foreign objects into said irrigation apparatus.

11. An irrigation apparatus comprising:

(a) a hose connection adapted to flow connect to a water supply;

(b) an infinitely adjustable valve flow connected to said hose connection and positioned relatively close thereto; said valve having a large flow orifice and being manipulative to allow variation of water flow through said large orifice and also being manipulative to allow no water flow through said large orifice;

(c) said valve also having a relatively small orifice therethrough to allow a small stream of water to pass therethrough when said valve is in a low flow position thereof; said small orifice being positioned generally perpendicular to said large orifice;

(d) a flexible hose arm flow connected to said valve; said arm having a plurality of spaced apertures therein flow connecting with said hose connection through said arm; said apertures being of a size to allow a trickle flow of water therethrough when said hose connection is connected to a water supply and when said valve is positioned such that water passes through said small orifice; and said apertures being of a size to allow a spray flow of water therethrough when said hose connection is connected to a water supply and when said valve is positioned such that water passes through said large orifice;

(e) a weighted element at a distal end of said flexible hose arm to oppose movement of the end of said flexible hose once in position due to water pressure or the like; and (f) said flexible hose arm being adapted to be wrapped around the base of a plant to allow for irrigation of the plant with an even distribution over a area surrounding the plant.

12. The irrigation apparatus according to claim 11 wherein:

(a) said small flow orifice is approximately one and one-half millimeter in diameter.

13. The apparatus according to claim 11 wherein:

(a) said arm comprises first and second arm sections of generally equal length; both said first and second arm sections originating relatively close to said valve and being flow connected therewith by a connecting manifold.

14. An irrigation apparatus comprising:

(a) a female threaded inlet connector adapted to be connected to a male threaded outlet connector of a water supply;

(b) said inlet connector having a filter located within to prevent solid foreign objects from passing into said irrigation apparatus;

(c) a valve having a valve body and being flow connected to said inlet connector and relatively closely spaced therefrom;

(d) said valve having a first relatively large diameter flow orifice through said valve body allowing a relatively large flow of water to pass through the valve when completely aligned with water flow from said water supply; said valve body being infinitely positionable to allow different flows through said first orifice, including no flow; said valve having a second relatively small orifice of approximately one and one-half millimeter in diameter through said body generally perpendicular to said first orifice; said second orifice allowing flow of water through said valve when said first orifice allows no flow;

(e) said valve being adjustable by a user by means of an actuator located on the exterior of said valve;

(f) a tee connection manifold flow connected to said valve;

(g) a pair of flexible hose arms with one end of each hose arm being flow connected to said manifold; each arm having a plurality of spaced apertures therealong and adapted to release streams of water over a defined area; each of said hose arms originating relatively close to said valve;

(h) said apertures being located near the top of said arms when in watering positioning and spaced such that streams of water spray both inward and outward when said arms are circularly positioned around a plant allowing for a relatively even distribution over an area surrounding the plant; said apertures being of a size to allow cooperation with said orifices during flow of water through said apparatus, such that when said valve is positioned such that water from said water supply passes through said large orifice then water sprays from said apertures and, when said valve is positioned such that water from said water supply passes through said small orifice, then water trickles from said apertures;

(i) each of said arms terminate in an end cap;

(j) each of said end caps includes a weighted element to oppose movement of said arm once in position by water pressure or the like.

* * * * *